US005861806A

United States Patent [19]

Vories et al.

[11] Patent Number: 5,861,806

[45] Date of Patent: Jan. 19, 1999

[54] OCCUPIED ROOM INDICATOR

[75] Inventors: Dennis L. Vories, Valley Center, Calif.; James A. Bondell, 2564 State St., Suite B, Carlsbad, Calif. 92008

[73] Assignee: James A. Bondell, Carlsbad, Calif.

[21] Appl. No.: 814,345

[22] Filed: Mar. 19, 1997

[51] Int. Cl.[6] ..... G08B 13/18

[52] U.S. Cl. ..... 340/555; 340/545; 340/556

[58] Field of Search ..... 340/545, 555, 340/556, 523, 541, 522, 546

[56] References Cited

U.S. PATENT DOCUMENTS

| | | | |
|---|---|---|---|
| 3,560,950 | 2/1971 | Peters . | |
| 3,611,333 | 10/1971 | Conigliaro | 340/545 |
| 4,023,151 | 5/1977 | Markham | 340/545 |
| 4,679,034 | 7/1987 | Kamada . | |
| 4,797,657 | 1/1989 | Vorzimmer et al. . | |
| 4,808,974 | 2/1989 | Cantley | 340/546 X |
| 4,993,049 | 2/1991 | Cupps . | |
| 5,153,560 | 10/1992 | Ichikawa | 340/541 X |
| 5,221,919 | 6/1993 | Hermans . | |
| 5,243,326 | 9/1993 | Disabato | 340/555 |
| 5,266,807 | 11/1993 | Neiger . | |
| 5,268,670 | 12/1993 | Brasch et al. | 340/541 |
| 5,309,146 | 5/1994 | Kenet . | |
| 5,428,345 | 6/1995 | Bruno | 340/541 |
| 5,476,221 | 12/1995 | Seymour | 236/47 |
| 5,499,016 | 3/1996 | Pantus | 340/555 |

*Primary Examiner*—Jeffery A. Hofsass
*Assistant Examiner*—Anh La

[57] ABSTRACT

When installed on a door to a room, e.g. a restroom, or other area where it is desired to monitor occupancy status of the room or other area, a light source (e.g. a light emitting diode) outside the room or area provides a visual signal to those outside the room or area whether it is occupied (flashing) or not (dark). Optionally there is a second light source, or other indicator, inside the room or area that signals, simultaneously with the outside light, to an occupant of the room or area that the device is properly working. Optionally "occupied" and "unoccupied" signals are sent to a remote station to keep a remote observer informed of the occupancy status of an out-of-sight room or area. For example, the remote signalling option can be used by persons to avoid useless trips to a distant restroom that is already occupied. Preferably an infrared sensor mounted in a cylindrical reflector in a casing mounted on the door senses movement of an occupant during a pre-set time period, i.e. window, after the door closes, the sensor's signals when the door is open are disabled. The movement of an occupant within the window causes a valid detection signal which latches an oscillator which in turn periodically energizes the light sources, indicating that the room is occupied. When the door opens the oscillator is stopped and the cycle repeats when the door closes.

20 Claims, 3 Drawing Sheets

OCCUPIED ROOM INDICATOR

BACKGROUND OF THE INVENTION

This invention relates in general to devices mounted on a door which use an infrared (IR) sensor to detect movement of a person in a room, and which provide an indication of same to an observer outside the room, and in particular to such devices which are small, compact, easily mounted, and which require no external wiring.

Almost everyone has had the experience of knocking on a closed restroom door only to hear the voice of someone inside announcing that the room is occupied. This is often embarrassing to the knocker as well as the occupant. Such a scenario is typical of environments having only a single person restroom, such as in many small and medium size work places throughout the country. This invention can be used to avoid such situations.

It also has a remote indication option which can save time by avoiding wasted trips to a remote restroom which is already occupied.

Although this invention is particularly advantageous for restrooms, as described above, it can also be used in any situation in which it is advantageous to have an inexpensive, easily installed, but yet effective means for indicating to persons outside of a room that a room is occupied.

Other advantages and attributes of this invention will be readily discernable upon a reading of the text hereinafter.

SUMMARY OF THE INVENTION

An object of this invention is to provide an inexpensive and compact device for indicating to persons outside of a room or other area, defined at least in part by a door, that the room or area is occupied.

A further object of this invention is to provide such a device which can also indicate to a person inside of the room or area that the device is actually working.

An additional object of this invention is to provide such a device that can easily and quickly be installed on a door.

An additional object of this invention is to provide such a device which can indicate the status of whether or not the room or area is occupied to a distant observer.

These objects, and other objects expressed or implied in this document, are accomplished by an apparatus for providing an indication observable by a person located outside of an area, which is at least partially bordered by a door, whenever one or more other persons are in the area. The apparatus includes a switching device mounted on the door for producing a first signal whenever the door is closed; a sensing circuit, responsive to the first signal, for producing a second signal whenever one or more persons are in the area; and an indicator, such as a light source energized by a circuit which responds to the second signal by energizing the light. The apparatus also preferably includes a timer for inhibiting the second signal after a preset time has elapsed (e.g. ten seconds) following a closing of the door (the inhibition remaining until the door is again opened) and a memory for remembering if a second signal occurred before the time elapsed. This provides only a limited window after the door is closed in which the apparatus will respond to movement of a person in the area in order to reduce the chance of the apparatus responding to environmental influences and other variations. The memory keeps the light energized until the door opens again even if the second signal should subsequently go away, such as if the person stops moving for a while. Preferably the sensor is sensitive to infrared radiation in a band typically emitted by humans, such as a band centered around a wavelength of about 10 microns, and the radiation emanating from the sensing area is magnified onto the sensor by a reflector, e.g. a cylindrical reflector.

DESCRIPTION OF THE PREFERRED EMBODIMENT

Figure 1:
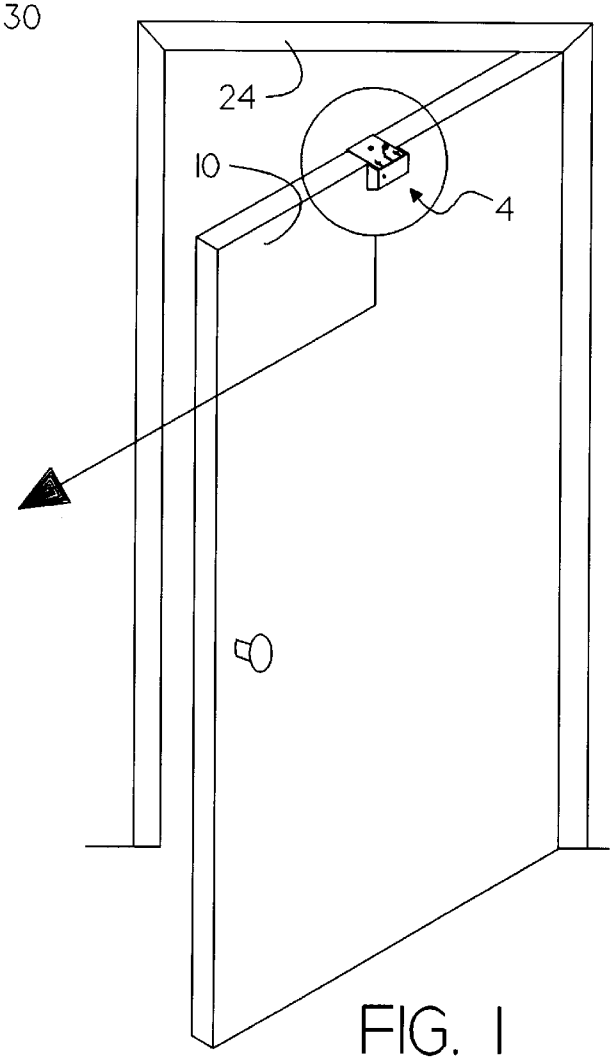
FIG. 1 is a pictorial view of this invention installed on a door to a room.
Figure 2:
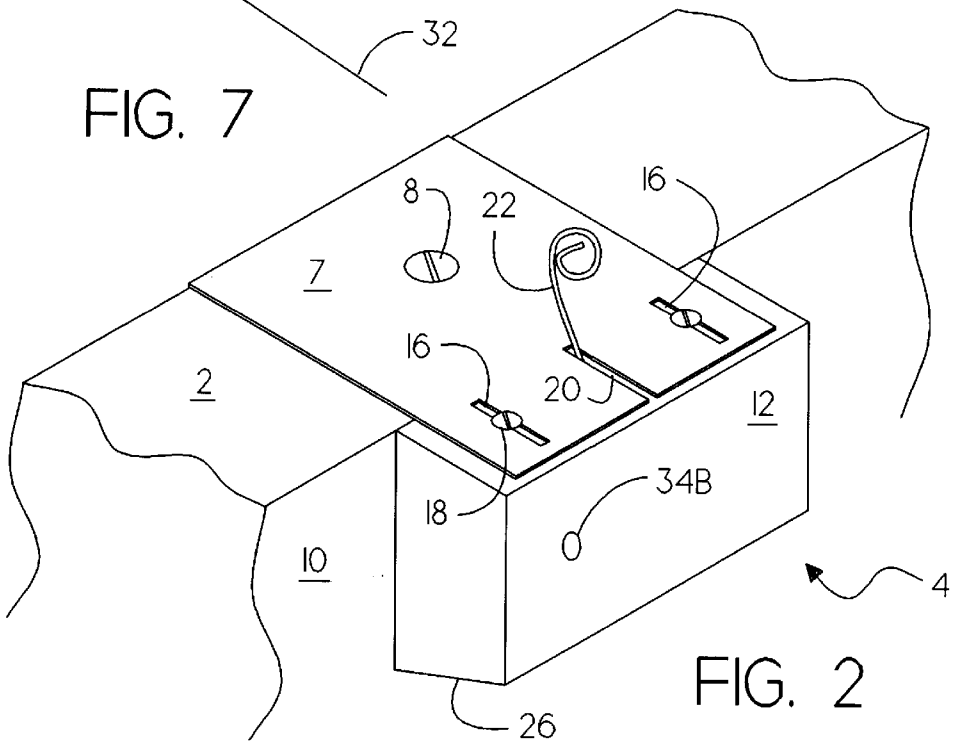
FIG. 2 is an enlarged partial view of FIG. 1 showing the installed invention in more detail.
Figures 3, 4:
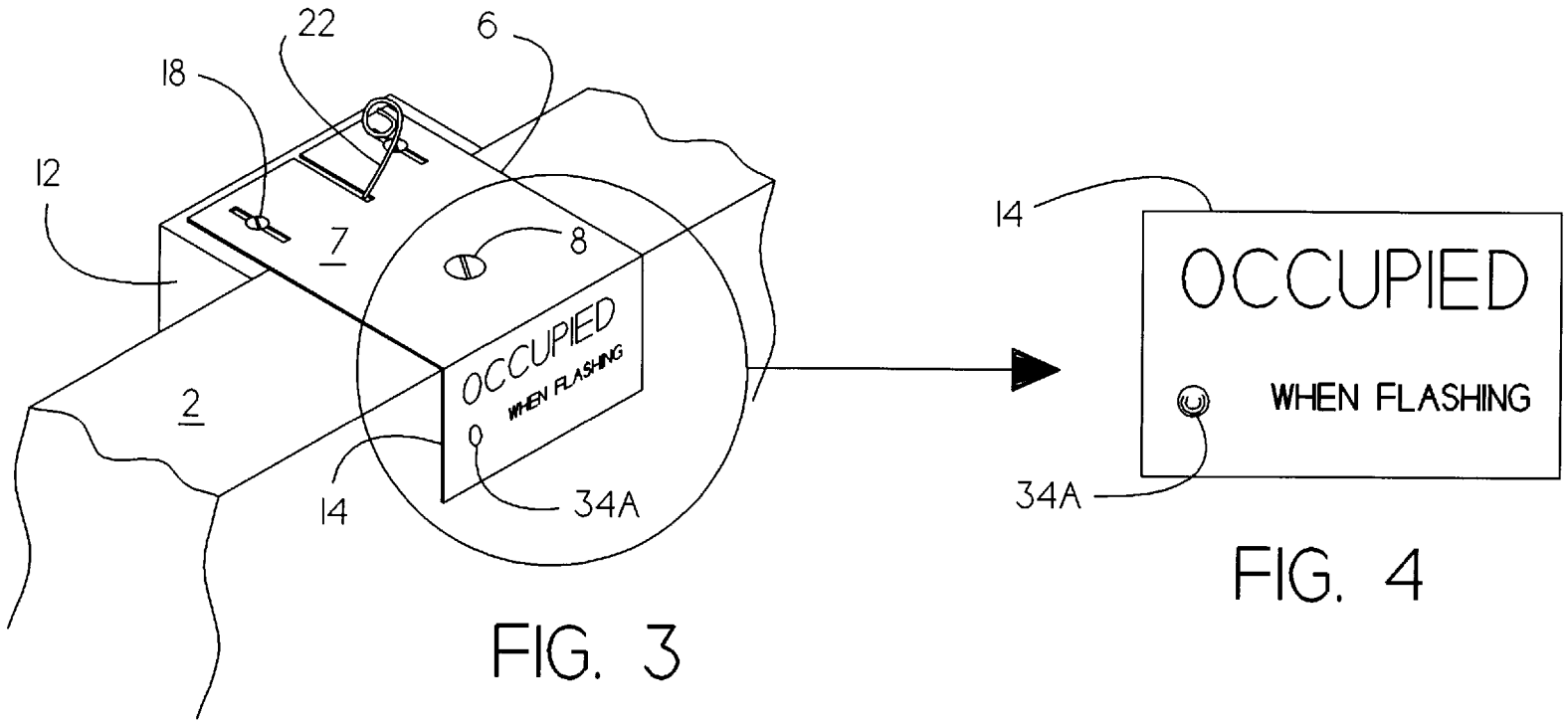
FIG. 3 is partial, pictorial view showing a reverse side of FIG. 2.
FIG. 4 is an enlarged partial view of FIG. 3 showing an "OCCUPIED" indicator portion of the installed invention in more detail.

Referring to FIGS. 1–3, a door 2 is illustrated to have a preferred embodiment of this invention, generally designated 4, mounted on a top edge of the door. An L-shaped mounting bracket 6 has a sheet-like shank 7 that straddles the top edge and is affixed thereto, as by a mounting screw 8. Preferably the shank of the "L" bracket is thin and wide, thin enough to easily fit within a pre-existing gap between the top of a door and the door frame. The shank projects beyond an inside 10 of the door far enough to support a casing 12. ("Inside" refers to the side of a door that, when closed, faces into the room or other area which is in the intended sensing field of this invention as described herein.) The "L" of the mounting bracket has a foot 14 which extends downward and is intended to abut the outside of the door to prevent the mounting bracket from pivoting about its mount, in this case the mounting screw 8. To support the casing, the shank defines a pair of parallel slots 16 through which screws 18 extend to affix the casing 12 to the bracket. During installation the slots allow the gap between the foot 14 of the "L" bracket and the casing to be adjusted to fit a range of door top widths. After adjusting the gap to fit a door, the screws in the slots are then tightened to hold the casing in fixed relation to the mounting bracket. Projecting upward from the top of the casing, through another slot 20 defined by the mounting bracket shank, is a wire lever 22. The lever is spring biased toward the door and is disposed to be moved by a door frame 24 when the door is closed. The lever controls a switch (38 of FIG. 5) inside the casing and movement of the lever by the door frame actuates the switch to inform a circuit inside the casing that the door is closed. As illustrated in the figures, the lever is generally vertical and disposed right next to the door's edge so that when the door is closed the lever is moved by the door frame to an extent necessary to actuate the switch. The switch is re-opened by the bias spring when the door is re-opened, and closed again when the door is subsequently closed, and so on.

Figure 8:
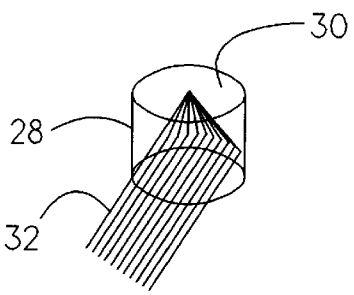
FIG. 8 is a diagrammatic illustration of how infrared radiation is magnified and redirected by a cylindrical reflector to the sensor.
Figure 7:
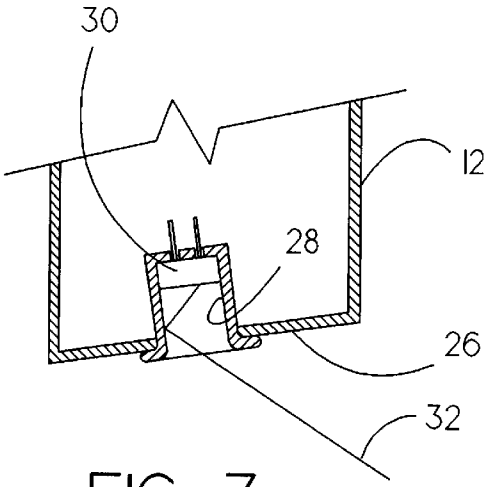
FIG. 7 is a cross-section of the invention detailing an infrared sensor.

Referring to FIGS. 7 and 8, the casing 12 has an inclined bottom surface 26 in which a cylindrical infrared reflector 28 is mounted. The cylindrical reflector is used to redirect and focus, i.e., magnify infrared radiation onto the window of an infrared sensor 30 to detect the presence of a person in the reflector's field of view. The infrared sensor 30 is mounted at the inside end of the cylindrical reflector with its window in the focus area of the reflector. Infrared radiation 32 emanating from a person in the sensing area enters the open end of the reflector and is reflected by the inside walls up to the window of the infrared sensor. As shown by FIG. 8, the cylindrical surface of the reflector tends to focus the rays onto the window. In this way the reflector actually has positive gain. The cylindrical reflector is preferably a polished metal or bright nickel, or chrome plated metal or plastic, so that the concave, cylindrical inside surface of the reflector has a shiny, polished surface which will readily magnify infrared radiation. As illustrated, the reflector is aimed downward and across the room or desired sensing area in order to detect even small persons. The vertical angle of the cylinder's long axis with the door is preferably between zero (aimed downward and parallel with the door) and forty-five degrees depending on the height at which the sensor is mounted on the door, the size of the area being monitored, the portion of the area in which a person is most likely to be while in the area. The distance that the sensor is set back from the open end of the cylinder is primarily determined by a trade-off between gain and the viewing angle of the sensor window; setting the sensor further back reduces the viewing angle but increases gain up to a point. It appears that the optimal set back distance is equal to the diameter of the cylinder.

Referring to FIGS. 2–4, the foot 14 of the mounting bracket 6 faces outside the room or sensing area and has a light emitting indicator, such as a light emitting diode (LED) 34A, mounted thereon or therein to indicate, e.g. by flashing, when the room or sensing area is occupied. The bracket foot also has indicia thereon, such as "OCCUPIED WHEN FLASHING," to inform an observer of the meaning of the flashing LED. Also preferably an LED 34B is mounted on the casing 12 so as to be observable by an occupant of the room or sensing area, and is energized concurrently with the outside LED to give the occupant confidence that the invention is working properly and that the outside LED is actually flashing.

Figure 5:
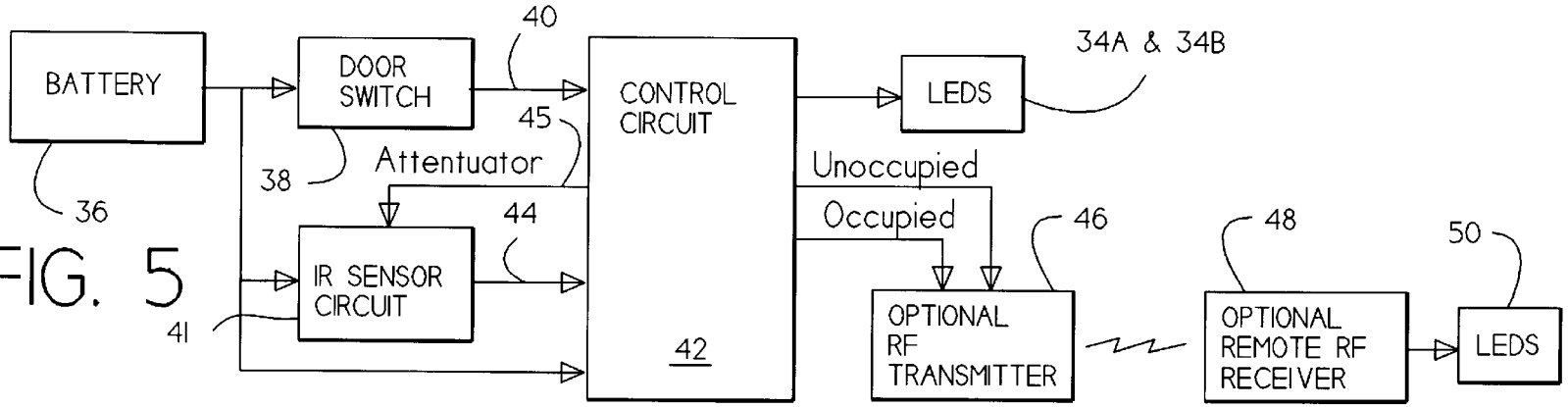
FIG. 5 is a functional block diagram of the invention.

Referring to FIG. 5, the invention is preferably battery powered, e.g. by two AA (1.5V) batteries 36 which can provide power for periods exceeding several years of typical use. Power is supplied continuously once the batteries are installed. In operation, a door switch 38 controlled by the wire lever 22 (FIG. 2) is closed when the door is closed. A signal 40 from the switch informs a control circuit 42 of this fact. During the 10 seconds immediately following the door closure, the control circuit looks for a movement signal 44 from an IR sensor circuit 41 to determine the presence of a person in the room or sensing area, and to latch flashing of the LEDs, 34A and 34B. The limited detection period of 10 seconds is generally plenty of time for a person to depart from the inside of the closed door, and it reduces the chances of false indicator latching caused by environmental influences or other variables. Once latched, the flashing will continue until the door once again opens which will be indicated by the absence of signal 40. Once the control circuit begins flashing the LEDS, the signal 44 from the infrared sensor no longer plays a part until the door has been re-opened and once again closed.

Referring again to FIG. 5, the control circuit also preferably controls the sensitivity of the IR sensor circuit by means of an "attenuator" signal 45 which increases its gain when the door is closed but decreases it substantially when the door is opened. The substantially reduced gain prevents false IR sensor signals 44 which might otherwise be caused by variations in background infrared radiation that the sensor might encounter when it is being moved by the door. Furthermore, the IR sensor circuit has means, explained below, for adapting to slow changes in the IR environment while the door is open or moving.

Referring again to FIG. 5, optionally the invention includes a radio frequency (RF) transmitter 46 which receives signals from the control circuit including an "unoccupied" signal indicating when the door is open, and an "occupied" signal indicating when the door is closed and a person has been sensed in the room during the ten second sensing window. In response, the transmitter broadcasts corresponding signals to one or more remote receivers 48 each of which can also include a device for remembering at least an "occupied" signal and a LED 50, or other indicating device, for indicating receipt of an "occupied" signal. This arrangement can provide multiple and remote indications of whether a room or sensing area is occupied. For example, a receiver can be located on the desk of a guard or receptionist to keep them informed as to if and when an out-of-sight room, such a restroom, is occupied. As another example, sensors located on the doors of multiple examining rooms of a medical clinic can all uniquely broadcast "occupied" and "unoccupied" signals to a centrally located receiver having multiple corresponding "occupied" indicators. This would be very helpful to a person who assigns the rooms to patients.

Figure 6:
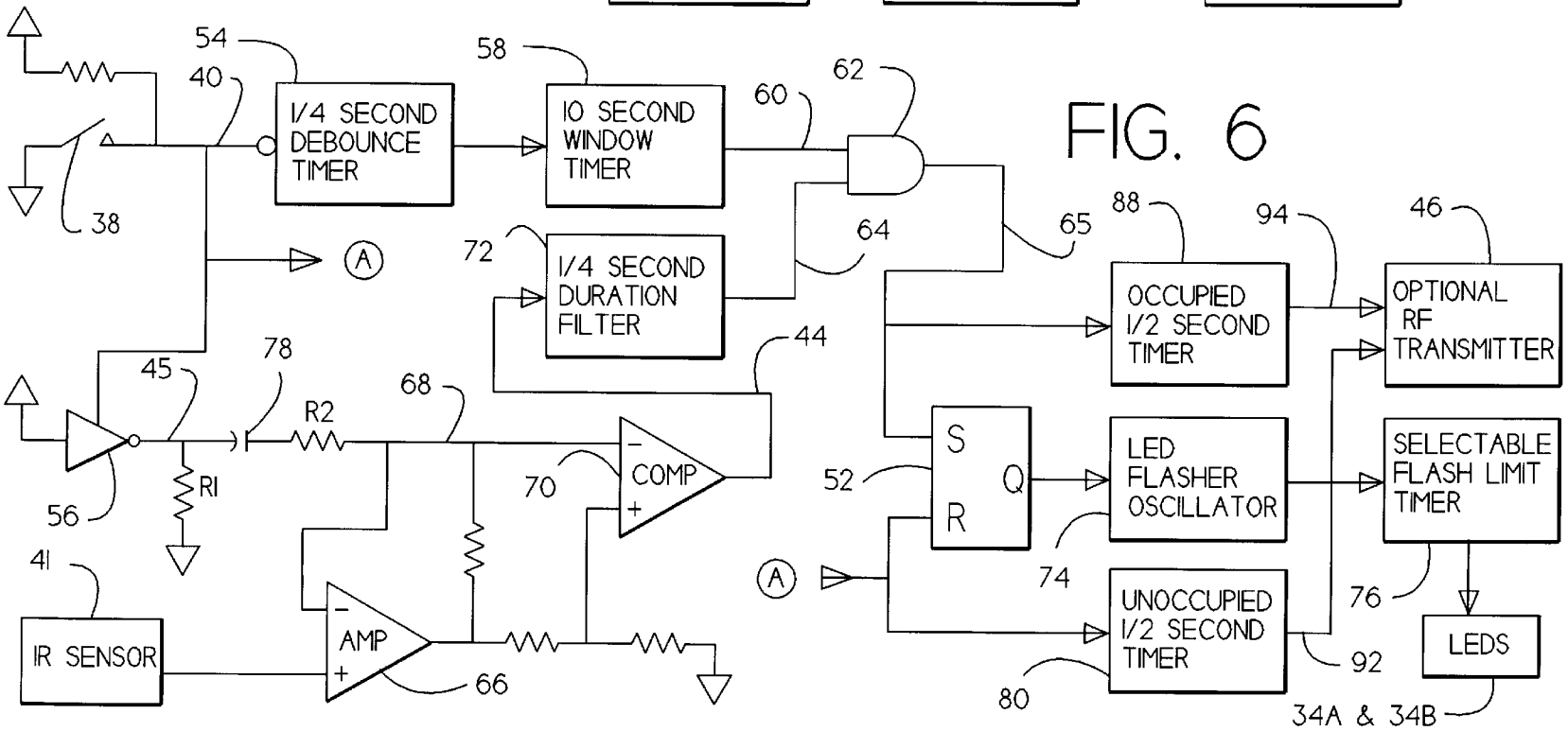
FIG. 6 is a more detailed functional block diagram of the invention.

Referring to FIG. 6, closure of switch 38 (door closed) removes a reset signal from a set/reset latch 52 in the control circuit, triggers a one-quarter second timer 54 used to debounce the switch signal, and changes the output of a tri-state inverter 56 from its high impedance state to its low impedance state. At the end of its period, the one-quarter second timer in turn triggers a ten second timer 58, which provides a true condition for ten seconds at a first input 60 of an AND gate 62. This provides a ten second window in which the control circuit waits for a "valid" IR signal at a second input 64 of the AND gate. A valid IR signal will occur when the output of the IR sensor 41, as amplified by amplifier 66, exceeds a threshold level 68 for at least one-quarter of a second. The threshold level and the output of the amplifier are applied to respective inputs of a comparator 70, and whenever the threshold is exceeded, the comparator sends a corresponding signal to a one-quarter second duration filter 72 which blocks the comparator signal unless it is true for at least one-quarter of a second. If the comparator signal is true for the requisite length of time, then the filter presents a true condition, indicating a valid IR signal, at the second input 64 of the AND gate. The coincidence of a valid IR signal and the ten second window at the AND gate inputs will cause it to send a signal 65 to the latch 52, setting the latch which in turn then enables an LED flash oscillator 74. The duration filter 72 ensures that the signal from the comparator is valid for at least one-quarter of a second before it is used to set the latch in order to avoid setting the latch by spurious signals. The signal from the oscillator is used to periodically energize the LEDS, indicating an occupied condition, preferably at a suitable but low duty cycle to preserve the batteries. A duty cycle is suitable if it is sufficient to make the flashing of the LEDS clearly noticeable to an observer.

Preferably the invention also includes a user selectable flash limit timer 76 to prevent unnecessary battery drain in the event of a false trigger. The timer provides a limit to the time that the LEDs can flash so that flashing does not continue indefinitely if falsely latched. The timer stops energization of the LEDs after a selected time has elapsed, e.g. 7.5, 15 or 30 minutes, or 1, 2, 4 or 8 hours.

When the door is opened, the door switch opens and the LEDs stop flashing (unless previously stopped by the flash limiter 76), and the logic sequence will repeat once the door is closed again. If the door is closed and the room is vacant, no valid IR signal will occur during the ten second window and the LEDs will remain dark, indicating that the room is non-occupied. Battery current drain for a closed-door, vacant restroom is negligible.

Referring again to FIG. 6, the closing of the door switch 38 changes the tri-state inverter 56 output from its high impedance state to a low state. When the door is closed, the tri-state inverter effectively shorts R1, which is about 100 times greater in resistance than R2, thereby increasing the amplifier gain by a factor of about 100 times. A capacitor 78 between R1 and R2 slowly charges or discharges through the feedback and input gain setting resistors to form an adaptive virtual ground reference for the amplifier with an offset voltage equal to that from the IR sensor applied to the input of the amplifier. The capacitor eliminates the DC offset inherent in signals from IR sensors, and changes in the DC offset due to changes in the sensor environment. In operation, the capacitor adapts to slow changes in the IR environment, even those that occur while the door is open or moving. This ensures that the amplifier will adapt to the IR background environment without amplifying the background offset, thereby maximizing its ability to amplify changes in the IR signal. When the door is open (and switch 38 is open) the gain of the IR amplifier 66 is correspondingly reduced to prevent false triggering due to infrared radiation received when the door is open.

Referring to FIGS. 5 and 6, as mentioned before the optional transmitter 46 can be included to transmit the occupancy status of the room or sensing area to a remote receiver 48. When the door switch 38 opens (door opened), a first one-half second timer 80 is triggered causing it to send a one-half second pulse 92 to the transmitter which responds by broadcasting an "unoccupied" signal. When the receiver senses the "unoccupied" signal, it will douse the LED 50. Conversely, when the AND gate 62 sets the latch 52, it also provides a signal to trigger a second one-half second timer 88 causing it to send a one-half second pulse 94 to the transmitter which responds by broadcasting an "occupied" signal. When the receiver senses the "occupied" signal, it will remember the signal and energize the LED 50, constantly or periodically, until it subsequently receives an "unoccupied" signal.

It should be understood that this invention may be used in a variety of possible applications including restroom stalls, portable toilets, conference rooms, offices, motel rooms, etc. Further, while the preferred embodiment of the invention has an LED both outside and inside the door, the invention may be used satisfactorily with only the outside LED, the one indicating the occupied status of the room or sensing area to those outside it.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the lever switch could be replaced by any kind of switching device capable of generating a signal which is distinguishable between when a door is open and when it is closed. Further, the invention could mounted on a door by any fastening means, not necessarily the L-shaped bracket as disclosed herein, as long as there is some path of communication between the sensing circuit on the inside of the door and an indicator outside the door.

We claim:

1. An apparatus for providing an indication observable by a person located outside of an area, which is at least partially bordered by a door, whenever one or more other persons are in the area, the apparatus comprising:

(a) means, when actuated, for producing a first signal;

(b) means for mounting the means for producing the first signal on the door, said means for producing the first signal being actuated whenever the door is closed;

(c) means, responsive to the first signal, for producing a second signal whenever one or more persons are in the area; and (d) means, responsive to the second signal, for providing the indication.

2. The apparatus according to claim 1 further comprising means for inhibiting the second signal after a preset time has elapsed following a closing of the door, the inhibition remaining until the door is again opened.

3. The apparatus according to claim 1 wherein the first signal is extant as long as the door is closed, and further comprising means, responsive to the first signal, for inhibiting the second signal after a preset time has elapsed following a closing of the door, the inhibition remaining until the first signal is no longer extant.

4. The apparatus according to claim 1 wherein the means for producing the second signal comprises:

(a) means for sensing electromagnetic radiation in the infrared range; and (b) means for magnifying electromagnetic radiation from the area onto the means for sensing.

5. The apparatus according to claim 4 wherein the means for magnifying comprises:

(a) a hollow cylinder having an infrared radiation reflective inner wall;

(b) a lens disposed at one end of the cylinder and facing the other end which is open to receive radiation; and (c) means for mounting the cylinder/lens combination at a top of the door, the open end of the cylinder facing angularly down at the area.

6. The apparatus according to claim 1 wherein the means for providing the indication comprises:

(a) a visible light emitter affixed to the outside of the door; and (b) means, responsive to the second signal, for energizing the emitter.

7. The apparatus according to claim 6 wherein the means for energizing the emitter comprises (a) means for remembering the second signal; and (b) means, responsive to the remembered second signal, for periodically energizing the emitter at a suitable duty cycle.

8. The apparatus according to claim 1 wherein the means for providing the indication comprises:

(a) means, responsive to the second signal, for broadcasting a corresponding signal;

(b) means, outside the area, for receiving the broadcasted corresponding signal and providing the indication in response thereto.

9. The apparatus according to claim 6 wherein the means for providing the indication comprises:

(a) means, responsive to the second signal, for broadcasting a corresponding signal;

(b) means, outside the area, for receiving the broadcasted corresponding signal and providing the indication in response thereto.

10. The apparatus according to claim 1 wherein the means for producing the second signal comprises:

(a) an infrared sensor which produces a sensor signal corresponding to movement of a person or persons in the area; and (b) means, having gain, for amplifying the sensor signal.

11. The apparatus according to claim 10 further comprising means for increasing the gain whenever the door is closed, and decreasing the gain whenever the door is open.

12. The apparatus according to claim 11 wherein the gain is increased by a factor, and decreased by an inverse of the factor.

13. The apparatus according to claim 10 further comprising means for comparing the amplified sensor signal with a reference voltage and for producing the second signal whenever the amplified sensor signal exceeds the reference voltage.

14. The apparatus according to claim 10 wherein the means for amplifying comprises a differential amplifier, and further comprises an adaptive virtual ground coupled to an input of the means for amplifying.

15. The apparatus according to claim 1 further comprising means for inhibiting the second signal unless said second signal has a duration equal to or greater than a preset minimum time period.

16. The apparatus according to claim 13 further comprising means for inhibiting the second signal unless said second signal has a duration equal to or greater than a preset minimum time period.

17. An apparatus for providing an visual indication observable by a person located outside of an area, which is at least partially bordered by a door, whenever one or more other persons are in the area, the apparatus comprising:

(a) means, when actuated, for producing a first signal;

(b) means, responsive to the first signal, for producing a second signal whenever one or more persons are in the area;

(c) means, responsive to the second signal, for providing the visual indication;

(d) casing means for containing all the aforesaid means;

(e) bracket means for mounting the casing means to the top of the door; and (f) lever means, extending from the casing means, for being moved whenever the door is closed, movement of the lever actuating said means for producing the first signal.

18. The apparatus according to claim 17 wherein the bracket means comprises:

(a) an L-shaped bracket, the shank of the "L" extending across the top of the door, the casing means being affixed to the head of the "L" and extending down an inside of the door, the foot of the "L" extending down the outside of the door; and (b) means for adjusting the gap between the casing means and the foot of the "L" to fit a range of door widths.

19. The apparatus according to claim 17 wherein the means for producing the second signal comprises:

(a) means for sensing electromagnetic radiation in the infrared range; and (b) reflective means for magnifying electromagnetic radiation from the area onto the means for sensing.

20. The apparatus according to claim 19 wherein the reflective means for magnifying comprises:

(a) a hollow cylinder having an infrared radiation reflective inner wall; and (b) a lens disposed at one end of the cylinder and facing the other end which is open to receive radiation, the cylinder/lens combination being disposed in an opening defined by a base of the casing means, the open end of the cylinder facing angularly down at the area.

* * * * *